United States Patent [19]

Moe

[11] Patent Number: 4,795,393

[45] Date of Patent: Jan. 3, 1989

[54] RECTANGULAR LINK CONSTRUCTION TOY

[76] Inventor: Dennis Moe, 2344 State Hwy. 16, La Crosse, Wis. 54601

[21] Appl. No.: 6,218

[22] Filed: Jan. 23, 1987

[51] Int. Cl.[4] ..... A63H 33/12

[52] U.S. Cl. ..... 446/123; 403/388; 446/113

[58] Field of Search ..... 446/113, 111, 123, 122, 446/108, 85, 86, 107; D21/108; D8/387, 499; 411/400, 401; 403/388, 408, 353

[56] References Cited

U.S. PATENT DOCUMENTS

| | | | |
|---|---|---|---|
| D. 48,675 | 3/1916 | Gilbert . | |
| D. 73,604 | 10/1927 | Gilbert . | |
| D. 284,393 | 6/1986 | Kassai | D21/108 |
| D. 285,226 | 8/1986 | Kassai | D21/108 |
| D. 285,948 | 9/1986 | Mazzoleni | D21/108 |
| 1,000,395 | 8/1911 | Frost | 446/122 X |
| 1,589,827 | 6/1926 | Wessel . | |
| 1,763,300 | 6/1930 | Gilbert . | |
| 1,779,826 | 10/1930 | Potter . | |
| 1,860,627 | 5/1932 | Sherman . | |
| 2,014,464 | 9/1935 | Bierbach | 446/123 X |
| 2,095,700 | 10/1937 | Heede . | |
| 2,332,752 | 10/1943 | Ratcliff | 403/388 |
| 2,426,326 | 8/1947 | Tooms . | |
| 2,733,786 | 2/1956 | Drake | 189/34 |
| 3,199,246 | 8/1965 | Fischer . | |
| 3,699,709 | 10/1972 | Schmidt . | |
| 3,979,855 | 9/1976 | Schmidt . | |
| 4,490,065 | 12/1984 | Ullrich et al. | 411/400 X |

FOREIGN PATENT DOCUMENTS

| | | | |
|---|---|---|---|
| 814859 | 9/1951 | Fed. Rep. of Germany | 446/123 |
| 195156 | 3/1923 | United Kingdom | 446/113 |

*Primary Examiner*—Mickey Yu

*Attorney, Agent, or Firm*—William J. Beres

[57] ABSTRACT

A construction toy including a plurality of rectangular plastic links which may be joined together to form three dimensional models. The links are made of injection molded plastic in various lengths, but of uniform width and thickness "t". Rectangular slots of square cross section, extend through the links, centered between their edges. The cross sectional sides of the slots are equal in dimension to "t". A "T" shaped plastic connector having a head and threaded shank is used with a mating nut to connect two or more links together in different configurations. The connector head and the end of the shank attached to the head are of equal square cross section, with a side dimension also equal to "t". Some of the links also include a plurality of interconnected perforations through which either a plastic bolt or the shank of a "T" connector is inserted to join the links together at various points along their length.

20 Claims, 2 Drawing Sheets

FIG. 1
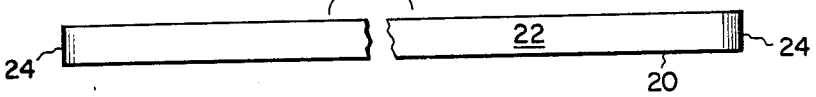
FIG. 2
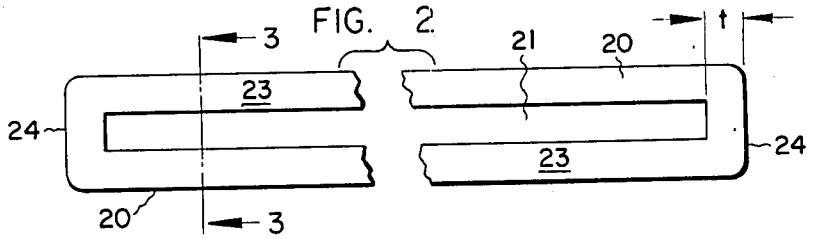
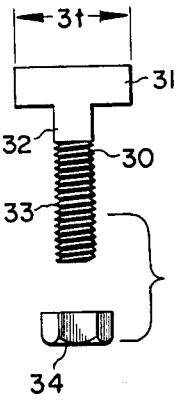
FIG. 4
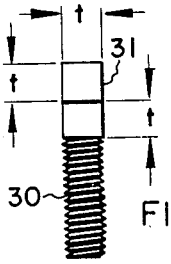
FIG. 5
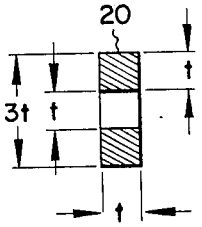
FIG. 3
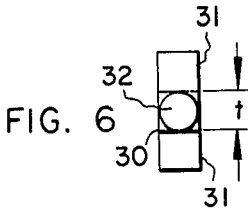
FIG. 6
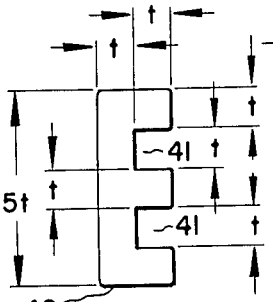
FIG. 7
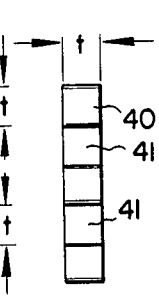
FIG. 8
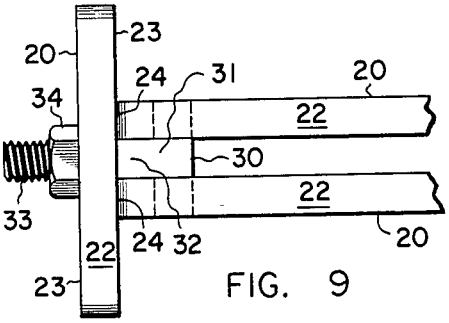
FIG. 9
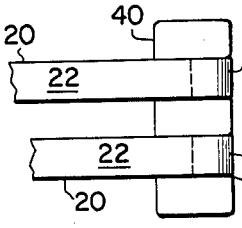
FIG. 11
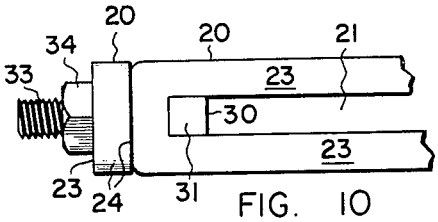
FIG. 10
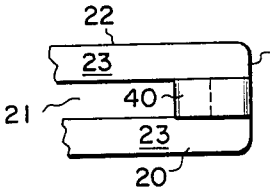
FIG. 12

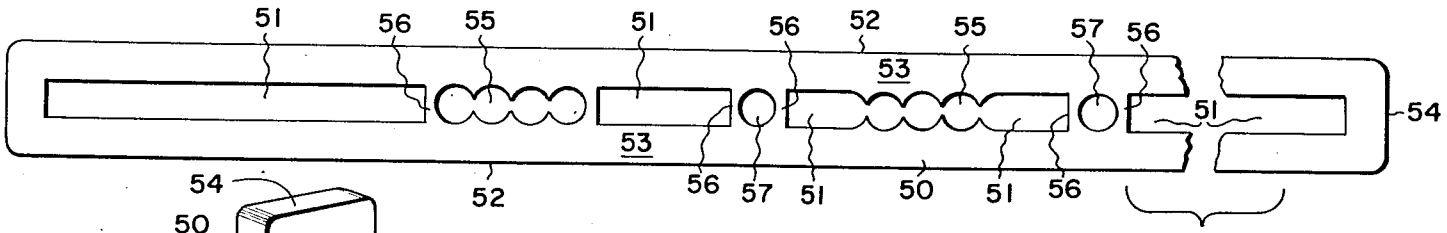
FIG. 13
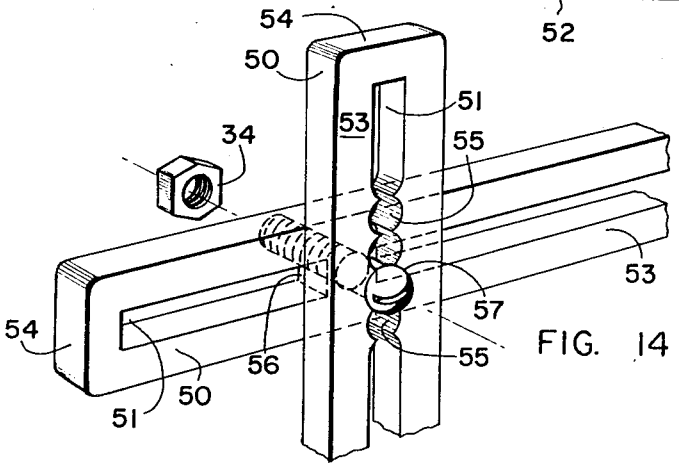
FIG. 14
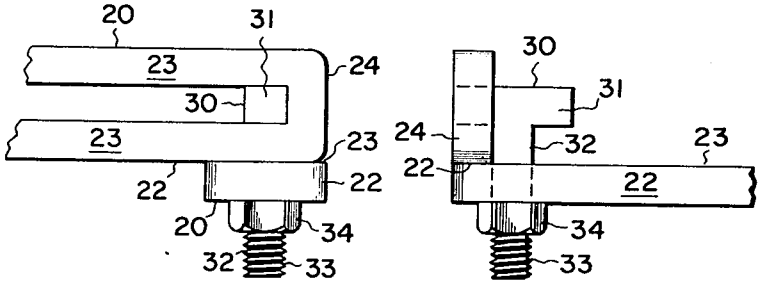
FIG. 16
FIG. 15
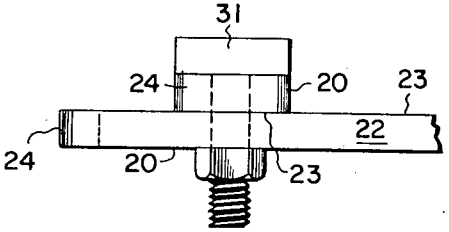
FIG. 18
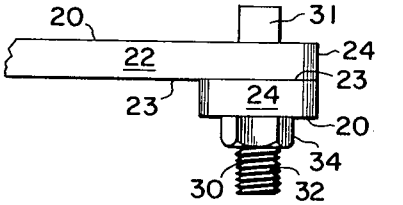
FIG. 17

RECTANGULAR LINK CONSTRUCTION TOY

BACKGROUND OF THE INVENTION

1. Technical Field

The subject invention generally pertains to a construction toy and specifically to a toy with links that are joined with a connector to form larger structures.

2. Background Art

Construction toys in the prior art have included flat pieces of plastic or metal with spaced apart holes through which bolts or other connectors may be inserted to join the links in a two dimensional structure. A common problem associated with such toys is the need to provide means to join a piece, so that a structure or model may be built in three dimensions. This is usually accomplished With right angle brackets to which the two pieces may be connected or by providing a right angle flange on one of the pieces to which the other pieces may be attached. The first solution requires a separate bracket and at least two connectors: the second constrains the pieces to be connected only at the flange.

The typical connector used in construction toys of the Erector TM set type is a bolt and nut which must be tightened very securely or else two spaced apart bolts must be used to join the two components, to prevent rotation of the pieces joined by the connector. A conventional bolt is incapable of engaging the end or edge of two pieces in abutment against the side of a third piece, nor is it easily adapted to act as a guide for the sliding motion of one component relative to another.

Aside from construction toys based on a building block concept, e. g. LEGOS TM, most sets use components that are relatively thin. Any structure built with such flat pieces tends to be less realistic and generally has less visual appeal than one made from components with three dimensional volume However, most construction toys using components having significant volume, such as brick-like blocks, have no means for solidly connecting the pieces. Instead, they rely on the friction fit between engaged pieces to hold the structure together.

In consideration of the above problems with prior art construction toys, it is an object of the subject invention to enable more realistic three dimensional models to be constructed with components that are securely fastened together.

A further object is to permit links of substantial thickness to be joined at right angles to each other without the need to provide a flange on one of the links or to use a right angle bracket.

A still further object is to provide a toy construction set connector that prevents the relative rotation of links joined by the connector without the need to excessively tighten a nut on the connector.

Yet a further object is to provide a link that has predetermined points along its length through which a connector may be inserted to join the link to another link.

These and other objects of the invention will be apparent from the attached drawings and the description of the preferred embodiment which follows hereinbelow.

SUMMARY OF THE INVENTION

A construction toy including a plurality of generally rectangular links that are equal in thickness and width. Each link has a generally rectangular slot centered between its edges and extending through its sides along its length. The slot is substantially square in cross section and is formed such that a side of the cross sectional area of the slot is equal both to the thickness of the link and to one-third the width of the link.

The toy also includes a "T" shaped connector having a head portion connected at its center to one end of a shank portion. The head and shank portions are substantially square in cross section and of equal dimension, with a side of the cross section being substantially equal to the side of the slot in the link. The other end of the shank portion is found and has threads formed on its circumference. The connector is selectively used with either its square head portion or square shank portion engaging the slot of one or more links and with the threaded portion of the shank extending through the slot of another link. A nut having threads matching those formed on the round end of the connector shank is threaded on the connector and tightened to secure the connector in place relative to the links it thus engages.

Another type of rectangular link in the construction toy includes a plurality of interconnected perforation centered between its edges and extending through its sides, along its length. Each of the perforations are generally round in shape, but open on at least one side to interconnect with an adjacent perforation due to the circumferences of the adjacent perforations overlapping. The diameter of the perforations is equal both to the thickness of the link and to one third the width of the link. Also included are one or more slots as described above. A threaded bolt is inserted through a selected one of the perforations in one or more of the links and through a perforation or slot in another link and a matching nut is threaded onto the bolt and tightened to secure the links in abutting relationship.

BRIEF DESCRIPTION OF THE DRAWINGS

FIG. 1 shows an elevation al view of one of the rectangular links of the subject invention.

FIG. 2 shows a plan view of the link.

FIG. 3 is a cross sectional view of the link taken along section line 3—3 of FIG. 2.

FIG. 4 illustrates a front view of the "T" shaped connector with matching nut.

FIG. 5 shows a side view of the connector.

FIG. 6 shows a bottom view of the connector.

FIG. 7 shows a front view of one embodiment of a spacer.

FIG. 8 shows the slotted edge of the spacer of FIG. 7.

FIG. 9 illustrates in plan view the manner in which the end of two rectangular links is secured in abutment against the side of a third link using the "T" shaped connector.

FIG. 10 illustrates the link connection of FIG. 9 in plan view.

FIG. 11 is a plan view showing how the "E" shaped spacer of FIGS. 7 and 8 is used to hold two links in parallel alignment.

FIG. 12 is an elevational view of the components of FIG. 11.

FIG. 13 is an elevational view of another embodiment of the rectangular link.

FIG. 14 is a perspective view showing the link of FIG. 13 connected to another link using a bolt.

FIG. 15 is an elevational view showing two links connected in edge-to-side relationship.

FIG. 16 is an elevational view in different aspect, of the links shown in FIG. 15.

FIG. 17 is an elevational view showing two links connected in side-to-side relationship.

FIG. 18 is an elevational view in different aspect, of the links shown in FIG. 17.

DESCRIPTION OF THE PREFERRED EMBODIMENTS

With reference to FIGS. 1, 2, and 3, a rectangular link 20 is shown having an elongate slot 21 disposed in the center of a side 23 of the link, extending along its longitudinal dimension. In the preferred embodiment, link 20 (as well as all other components of the construction toy described hereinbelow) is formed of injection molded plastic. Link 20 may be formed in several lengths, however, each such link has the same width and thickness dimensions.

Slot 21 is square in cross section, as shown in FIG. 3, with the sides of the slot equal in dimension to "t". The width of side 23 of link 20 is equal in dimension to three times "t", and the thickness of edge 22 is equal in dimension to "t". Likewise, the distance between the end of slot 21 and the end 24 of link 20 is equal in dimension to "t".

A generally "T" shaped connector 30 is shown in FIGS. 4, 5, and 6. ? ? objector 30 includes a head 31 the center of which is joined to one end of a shank 32. Both the head 31 and the end of shank 32 which is joined thereto have a square cross section with a side equal to "t". The length of the head is equal in dimension to three times "t". The other end of the shank 32 is round and includes conventional helical threads 33 formed around its circumference. A nut 34 is provided for use with connector 30 and is sized to fit on shank 32, mating with threads 33. The length of the square portion of shank 32 is slightly less than "t".

The importance of the dimensional relationship of the components of the construction toy thus far described is illustrated in FIGS. 9 and !0 and further discussed hereinbelow. In these figures, two longer links 20 are joined in parallel alignment to each other, with their ends 24 abutting the side of a relatively shorter link 20, at a right angle thereto. Connector 30 is used to hold the three links in position. Each end of head 31 engages slot 21 in one of the two longer links 20, and the threaded portion of shank 32 extends through the slot 21 of the shorter link 20. Nut 34 is threaded onto threads 33 and tightened against the side of shorter link 20 to hold the links in engagement with the connector. It will be apparent that head 31 of connector 30 fits snugly within slots 21 of the longer links 20 and that the square portion of shank 32 spaces the two longer links 20 apart by a dimension equal to "t". Since only the threaded portion of shank 32 extends through slot 21 in the shorter link 20, the structure comprising the longer links 20 may be rotated about the longitudinal axis of the connector shank 32, relative to the longitudinal axis of the shorter link 20. This arrangement thus enables links 20 to be connected at a right angle to each other in various configurations forming a structure with substantially more volume than toys built with flat components and much greater strength than friction fit blocks.

As illustrated in FIGS. 15 and 16, the edge 22 of a link 20 may be joined in abutment With side 23 of another link 20 using connector 30. Head 81 of connector 30 is engaged in slot 21 of link 20 and shank 32 extends at right angles to the longitudinal dimension of the engaged link through slot 21 of another link 20, the side 23 of which abuts against edge 22 of the first link. Nut 34 is threaded onto shank 32 and drawn tight against side 23 of the second link 20. The second link 20 can be rotated about the axis of connector shank 32. The free end of head 31 can also engage slot 31 of a third link 20, holding it in parallel alignment with the first link 20.

A further illustration of the manner in which connector 30 may be used to join two or more links 20 is shown in FIGS. 17 and 18. In this case, shank 32 of connector 30 extends through slots 21 in two links 20, with head 31 misaligned with the longitudinal dimension of the slot 21 in the link adjacent head, i. e. across the width of the upper link 20 as shown in the drawing figures, so that the head does not slip through the slot. Nut 34 is threaded onto shank 32 and tightened to hold the links together.

In addition to securing two links together, head 31 can serve as a guide for one link 20 as it slides across the longitudinal axis of a second link 20. This configuration is merely a variation of that shown in FIGS. 17 and 18. To act as a guide, head 31 is aligned with and seated in slot 21 of the top link 20, but misaligned with slot 21 of the lower link, and is held in place on the lower link 20 by tightening nut 34. Thus the top link 20 is free to slide along connector head 31 which serves as a guide. Other components would normally be used to prevent top link 20 from disengaging the connector head 31.

FIGS. 7, 8, 11, and 12 show a spacer 40 and illustrate one way in which it is used in the construction toy. Spacer 40 is generally "E" shaped, having two slots 41 along one edge. Its width is equal in dimension to two times "t", its length to five times "t", and its thickness to "t". Slots 41 are square, with a side equal in dimension to "t" and spaced apart by a distance equal to "t" As shown in FIGS. 11 and 12, spacer 40 is used to hold two links 20 in spaced apart parallel alignment. Spacer 40 extends through slots 21 in each of the two links 20 and slots 41 in the spacer engage the links adjacent their ends 24. It will be apparent that spacer 40 may be used in many other configurations with links 20 to hold the links in spaced apart relationship.

Turning now to FIG. 13, a second embodiment 50 of the links already described is shown. Link 50 may be provided in different lengths, however its side 53 has the same dimension as side 23, and its edge 52 the same thickness as that o link 20. It includes one or more slots 51 having a square cross section with a side dimension equal to that of slot 21. In addition, it includes a plurality of interconnected perforations or holes 55 extending through the sides of link 50 and centered between its edges 52. The circumferences of perforations 55 overlap slightly such that one or more sides of adjacent perforations 55 are open to each other. The last perforation 55 in a series of interconnected ones may be open to a slot 51 or closed with a cross web 66 that extends between the edges 52. Also included are singular perforations 57 which are centered in webs 56. Singular perforations 57 are spaced at predetermined intervals along the length of link 50, their centers dividing the link into simple fractional intervals, e.g. one-half, one-third, onefourth. This permits links 20 or 50 to be connected at pre determined points along link 50. The length of the various links 20 and 50 provided in a typical construction toy set are integer multiples of the shortest link.

FIG. 14 illustrates the manner in which two links 50 are connected with sides 63 abutting, sing a bolt 60 and mating nut 34. The interconnected perforations 5 permit the bolt to engage the top link 50 without sliding, while the singular perforation 57 provides a predetermined reference point for the connection o n the lower link 50. Links 50 may be rotated about the axis of bolt 60 prior to tightening nut 34. Connector 30 and spacer 40 can also be used with link 50 in substantially the same manner illustrated and discussed above for their use with link 20. It will be apparent that various combinations of slots 51, interconnected perforations 55, and singular perforations 57 may be provided in link 50. In a shorter link 50, fewer slots and perforations are provided than in a longer one.

An important characteristic of this construction toy is the virtually infinite variety of structures that may be built from the component parts. Many other configurations of the components comprising the subject construction toy are possible within the scope of the claims that follow besides those described hereinabove. The scope of the invention should thus be determined solely by reference to the claims that follow.

I claim:

1. A construction toy comprising:

a plurality of generally rectangular slotted links of thickness, "t";

a connector having a head, the center of which is connected at a right angle to a threaded shank, said head having a square cross section, the side of which is equal in dimension to "t"; and a nut with threads matching those on the connector shank, said connector head being inserted into the slots on two of the links to engage the slots and to hold the links in place when the nut is threaded onto the shank and tightened.

2. The construction toy of claim 1 wherein the said connector head is of a length equal to three times "t".

3. The construction toy of claim 1 wherein the end of the shank adjacent its connection to the head of the connector is square in cross section and is equal in cross sectional dimension to the head, and wherein the other end of the shank is round in cross section and threaded.

4. The construction toy of claim 1 wherein the slot in the links is rectangular and square in cross section, having a side equal in dimension to "t" and wherein the slot is centered between the edges of each link, extending through the sides along the length of the link.

5. The construction toy of claim 1 wherein the links each have a width equal in dimension to three times "t".

6. The construction toy of claim 1 wherein one or more of the links include generally round perforations extending through the side of the link and slightly larger in diameter than the diameter of the threaded connector shank

7. The construction toy of claim i further comprising a generally -rectangular spacer of thickness "t", having a plurality of spaced apart square slots along one edge, each slot having a side equal in dimension to "t".

8. The construction toy of claim 7 wherein the spacer is generally "E" shaped and has two slots and wherein the spacing between adjacent sides of the slots is substantially equal in dimension to "t".

9. The construction toy of claim 1 wherein the links include a slot adjacent at least one end, spaced apart from said end by a dimension equal to "t".

10. A construction toy comprising:

a plurality of generally rectangular links, each link being equal in thickness and width, and each link having a generally rectangular slot centered between its edges and extending through its sides along its length, said slot being substantially square in cross section and formed such that& a side of the cross sectional area of the slot is equal both to the thickness of the link and &o one-third the width of the link;

a "T" shaped connector having a head portion connected at its center to one end of a shank portion, the head portion and said one end of the shank portion being substantially square in cross section, with a side of the cross sections of the shank portion and of the head portion being substantially equal to each other and to the side of the slot cross section, the other end of said shank portion being round and having threads formed on its circumference; and a nut having threads matching those formed on said other end of the connector shank portion, said connector being selectively used with either its square head portion or square shank portion engaging the slot of one or more links and with the threaded portion of the connector shank extending through the slot of another link, said nut being threaded o the connector shank and tightened to secure the connector in place relative to the links it thus engages

11. The construction toy of claim !0 wherein the length of the head portion of the connector is equal to three times the cross sectional side of the slot.

12. The construction toy of claim 10 wherein each end of the head portion o the connector engages both a slot disposed adjacent the end of a first link and a slot disposed adjacent the end of a second link, and wherein the shank of the connector extends parallel to he length of the first and second links with the threaded portion extending through a slot disposed in a third link that is positioned at a right angle to the first and second links with one of its sides abutting their ends, said nut being threaded on the connector shank and tightened against the other side of the third link to hold the three links together.

13. The construction toy of claim 10 wherein one end of the head portion of the connector engages a slot in a first link and the other end engages a slot in a second link, and wherein the shank of the connector is at a right angle to the length of the first and second links with its threaded end extending through a slot formed in a third link that is positioned with its side abutting the edges of the first and second links and held in place as said nut is threaded on the connector shank tightened against the opposite side of the third link.

14. The construction toy of claim 10 wherein the head portion of the connector is disposed at right angles to the length of a first link, with the square portion of the connector shank extending through a slot in said first link and with the threaded portion of its shank extending through a slot in a second link having one side abutting against one side of the first link, said nut being threaded on the connector shank and tightened against the other side of the second link to hold the first and second links together.

15. The construction toy of claim 10 wherein the head portion of the connector is disposed at right angles to the length of a first link, with the square portion of its shank extending through a slot in said first link and with the threaded portion having a nut threaded thereon and tightened against the other side of the first link to hold the connector in place, a slot of a second link being disposed to slidingly engage the head portion of the connector so that the second link is free to slide at an angle relative to the first link as defined by the angle of the connector head but is thus prevented from rotating relative to the first link by said connector head.

16. The construction toy of claim 10 further comprising a spacer having a plurality of open slots disposed on one edge, each of said slots being generally square in shape and having a side dimension equal to the thickness of the links, said spacer slots being thus adapted to engage a plurality of links in spaced apart alignment.

17. The construction toy of claim 16 wherein the spacer is generally "E" shaped.

18. A construction toy comprising:

a plurality of connectors, each of said connectors having a head and a shank, the head of said connectors being square in cross section and said shank having an end attached to said head that extends therefrom at a right angle, the cross section of said end of said shank attached to said head being identical to the cross section of said head, the end of said shank opposite said end attached to said head being circular and threaded;

a plurality of nuts having threads matching the threads on said connector shank; and a plurality of generally rectangular links, each of said links having a slot, the cross section of said slots being identical to the cross section of said connector heads, pairs of said links being rigidly connectable to third ones of said links by the disposition of one of said connectors so that the shank of said one of said connectors penetrates the slot of said third one of said links and so that the head of said one of said connectors is disposed in a slot of each of said pair of links and, by the tightening of one of said nuts onto the threaded end of said one of said connectors so that said nut abuts said third one of said links.

19. The construction toy according to claim 18 further comprising means for spacing a pair of said links so that a space is defined between said pair of links which has a cross section identical to the cross section of a connector head.

20. The construction toy according to claim 19 wherein at least a portion of said plurality of links are perforated, said perforations being circular and of a diameter which exceeds the diameter of said threaded shank ends.

* * * * *